United States Patent [19]

Donohie et al.

[11] Patent Number: 4,679,694

[45] Date of Patent: Jul. 14, 1987

[54] CARTON AND BLANK FOR PACKAGING ICE CREAM OR THE LIKE

[75] Inventors: Paul J. Donohie, Pittsford; Gary L. Gray, Fairport; Frank G. Capuano, Rochester, all of N.Y.

[73] Assignee: Rendoll Paper Company, Rochester, N.Y.

[21] Appl. No.: 852,293

[22] Filed: Apr. 15, 1986

[51] Int. Cl.[4] ..... B65D 5/54

[52] U.S. Cl. ..... 206/611; 206/605; 206/614; 206/624; 229/154; 229/905

[58] Field of Search ..... 206/611, 605, 608, 609, 206/614, 615, 624, 634; 229/154, 905, 44 R

[56] References Cited

U.S. PATENT DOCUMENTS 3,310,223 3/1967 Buttery ..... 206/624
3,361,328 1/1968 Buttery ..... 229/154
3,409,205 11/1968 Meyers ..... 229/154
3,981,434 9/1976 Ramich ..... 206/624
4,361,236 11/1982 Lavery ..... 206/611

*Primary Examiner*—Willis Little
*Attorney, Agent, or Firm*—Shlesinger Arkwright Garvey & Fado

[57] ABSTRACT

The present invention pertains to a carton and a blank and a method for forming the carton for packaging ice cream or the like. The carton blank comprises front, bottom, rear and cover panels. A closure flap is hingedly connected to a top edge of the cover panel that opposes the rear panel. An end flap extends from each end edge of the cover panel, rear panel, bottom panel and front panel. A single tear strip is formed in the closure flap. Also, a single tear strip is formed in the end flap extending from the front panel. Upon removal of the tear strips, the carton can completely unfold and the contents therein can be readily accessed in brick form from all sides.

16 Claims, 9 Drawing Figures

CARTON AND BLANK FOR PACKAGING ICE CREAM OR THE LIKE

FIELD OF THE INVENTION

This invention pertains to a blank and carton for packaging ice cream or the like and more particularly to means for readily gaining access to the packaged article.

BACKGROUND OF THE INVENTION

This invention relates to a blank and a carton for packaging ice cream or the like.

The use of weakness lines or tearstrips on a closure flap and on adjacent end walls hinged to a cover panel of a carton for packaging ice cream or the like is disclosed in U.S. Pat. Nos. 3,111,255 to Skowronski; 3,209,103 to Bixler; 3,432,090 to Engel; 3,758,023 and 3,409,205 to Meyers; 3,168,075, 3,731,870, 3,310,222 to Buttery; and 3,197,115 to Peter. Placement of the weakness lines or tearstrips in this manner allows an edge of the cover panel to be separated from the body of the carton while maintaining the body portion of the carton intact.

The uses of weakness lines or tearstrips on a closure flap and on end walls hinged to a bottom panel of a carton is disclosed by Meyers in U.S. Pat. No. 4,102,457 and Perry in U.S. Pat. No. 4,046,313. Similar to the placement of the weakness lines or tearstrips on the end walls hinged to the cover panel, this arrangement allows an edge of the cover panel to be separated from the body portion of the carton while maintaining the body portion intact.

The arrangement of the tear lines in the manner described above does not permit complete access to the packaged article. One can only access the packaged article through the top portion of the container.

Prior to this invention, it has not been known to form weakness lines or tearstrips in a container in such a manner so that upon opening, the container is completely laid flat permitting easy access to its contents.

OBJECTS AND SUMMARY OF THE INVENTION

Accordingly, it is an object of this invention to provide an improved blank and carton for packaging ice cream or the like.

Another object of this invention is to form weakness lines or tearstrips in a carton for packaging ice cream or the like, where upon opening the packaged article can be fully accessed from all four sides and the top.

A further object of this invention is to provide an improved method of assembling a carton for packaging ice cream or the like.

Yet another object of the invention is to shape end flaps hinged to the cover panel in such a manner as to maintain the proper seal required against leaking, as well as to provide ease of assembly.

Still a further object of the invention is to provide clearance cuts in the appropriate end flaps for easy assembly of the carton.

A further object of the invention is to provide a blank and carton which are easy to manufacture.

Another object of this invention is to provide an ice cream carton which can be manufactured in multiple, from web or sheet stock, with little waste or scrap produced during blanking operation.

In summary, the present invention discloses a blank and a carton having a plurality of tearstrips formed therein where upon removal of the tearstrips the packaged article can be fully accessed.

DETAILED DESCRIPTION OF THE INVENTION

FIG. 1

Figure 1:
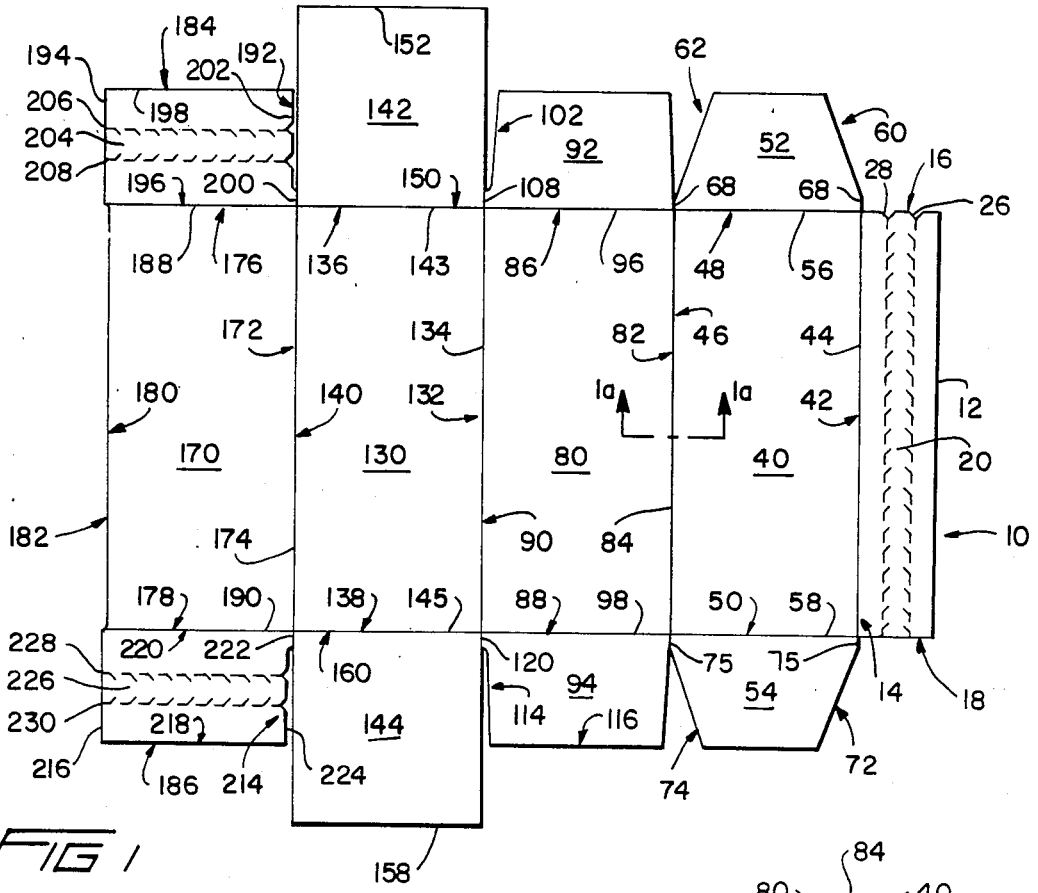
FIG. 1 is a plan view of the inner surface of a flat carton blank formed in accordance with this invention.
Figure 1A:
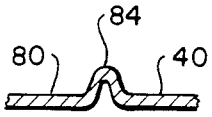
FIG. 1*a* is a fragmentary cross-sectional view taken along lines 1*a*—1*a* as seen in the direction of the arrows.

A blank B is comprised of closure flap 10, cover panel 40, rear panel 80, bottom panel 130 and front panel 170. The closure flap 10 has a top edge 12, a bottom edge 14 and left and right edges 16 and 18 respectively. A tear strip 20 is formed in closure flap 10. The tear strip 20 includes weakness lines 22 and 24. The left edge of closure flap 10 has notches 26 and 28 formed therein. The notches 26 and 28 are aligned with tearlines 22 and 24 respectively. The notches 26 and 28 aid in removal of tearstrip 20. The tearstrip 20 partitions closure flap 10 into subsections 30 and 32.

Cover panel 40 is hingedly connected at its top edge 42 to bottom edge 14 of closure flap 10. A hinge line 44 is formed therebetween. Cover panel 40 further includes a bottom edge 46, a left edge 48, and a right edge 50. End flaps 52 and 54 are hingedly connected to left and right edges 48 and 50 of cover panel 40, forming hinge lines 56 and 58 therebetween. The end flap 52 includes upper edge 60, lower edge 62, inner edge 64 and outer edge 66. Upper edge 60 and lower edge 62 have first and second portions 68 and 70. First portion 68 forms a right angle with hinge line 56. The first portion aids in maintaining the seal of the carton C thus preventing leakage of the packaged article. The second portion 70 forms an obtuse angle, less than 180°, with first portion 68. This angular cut in end flap 52 facilitates assembly of the carton C. End flap 54 includes upper edge 72, lower edge 74, outer edge 76, and inner edge 78. Upper and lower edges 72 and 74 have first and second portions 75 and 77.

Rear panel 80 is hingedly connected at its top edge 82 to the bottom edge 46 of cover panel 40 forming inwardly extending hinge line 84. Rear panel 80 further includes left edge 86, right edge 88, and bottom edge 90. End flaps 92 and 94 are hinged at left and right edges 86 and 88 of rear panel 80 respectively, forming inwardly extending hinge lines 96 and 98 therebetween. End flap 92 includes upper edge 100, lower edge 102, outer edge 104, and inner edge 106. Upper edge 100 extends along hinge line 84. Lower edge 102 has a first and a second portion 108 and 110. The first portion 108 extends a short distance from hinge line 96 and is perpendicular thereto. The first portion 108 is designed to maintain the seal of carton C. The second portion 110 is inwardly offset from first portion 108. The clearance thus formed aids in assembly of the carton C. End flap 94 includes upper edge 112, lower edge 114, outer edge 116, and inner edge 118. Lower edge 114 has first and second portions 120 and 122 identical to first and second portions 108 and 110 of lower edge 102.

Bottom panel 130 is hingedly connected at its top edge 132 to the bottom edge 90 of rear panel 80. An inwardly extending hinge line 134 is formed between bottom panel 130 and rear panel 80. The bottom panel 130 includes left edge 136, right edge 138, and bottom edge 140. End flaps 142 and 144 are hingedly connected at left edge 136 and right edge 138 forming hinge lines 143 and 145. End flap 142 comprises upper edge 146, lower edge 148, inner edge 150 and outer edge 152. Upper and lower edges 146 and 148 run substantially parallel to one another. Upper edge 146 extends along hinge line 134. End flap 144 includes upper edge 154, lower edge 156, outer edge 158 and inner edge 160. The dimensions of end flap 144 are identical to end flap 142.

Front panel 170 is hingedly connected at its top edge 172 to bottom edge 140 of bottom panel 130 forming hinge line 174 therebetween. Front panel 170 further includes a left edge 176, a right edge 178, and a bottom edge 180. The bottom edge 180 has a recessed portion 182 running substantially its entire length. The recess 182 ensures that cover panel 40 is properly fitted to front panel 170.

End flaps 184 and 186 are hingedly connected to left edge 176 and right edge 178 of front panel 170, forming hinge lines 188 and 190. End flap 184 comprises an upper edge 192, a lower edge 194, an inner edge 196, and an outer edge 198. Upper edge 192 includes first and second portions 200 and 202. First portion 200 extends along hinge line 174 and forms a right angle with hinge line 188. First portion 200 performs the same function as first portions 108 and 120 of end flaps 92 and 94, i.e. maintaining the seal of the carton C. The second portion 202 is inwardly offset from first portion 200. Second portion 202 provides a clearance between end flap 142 and end flap 184 to facilitate assembly of the carton C. A tearstrip 204 is formed in end flap 184 having weakness lines 206 and 208. Notches 210 and 212 are aligned with weakness lines 206 and 208 respectively to permit unhingered removal of tearstrip 204.

End flap 186 comprises upper edge 214, lower edge 216, an outer edge 218, and an inner edge 220. Upper edge 214 includes first and second portions 222 and 224. First and second portions 222 and 224 are similar to first and second portions 200 and 202 of end flap 184. A tearstrip 226 is formed in end flap 186 and runs substantially parallel to hinge line 190. Tearstrip 226 includes weakness lines 228 and 230 aligned with notches 232 and 234 respectively. Notches 232 and 234 aid in removal of tearstrip 226.

Cover end flaps 52 and 54, rear panel end flaps 92 and 94, and front panel end flaps 184 and 186 extend on equal distance from their respective hinge lines. The bottom panel end flaps 142 and 144 extend from their respective hinge lines a distance greater than the distance the cover panel end flaps, rear panel end flaps, and front panel end flaps extend from their respective hinge lines. This particular sizing of the end flaps 52, 54, 92, 94, 142, 144, 184 and 186 significantly decreases the amount of waste material produced during the manufacturing of the blank B.

Rear panel end flaps 92 and 94, and front panel end flaps 184 and 186 extend a distance from their respective hinge lines greater than half the length of bottom panel 130. The dimensioning of the end flaps in this manner ensures the necessary overlap between end flaps 92 and 184, and end flaps 94 and 186 for affixing the corresponding end flaps.

The hinge lines 44, 56, 58, 84, 96, 98, 134, 143, 145, 174, 188 and 190 are uniformed and inwardly extending. These features facilitate manufacture of the blank B and subsequent forming of carton C.

Although the above described embodiment is preferred, it should be noted that tearstrips 224 and 226 can be formed in rear panel end flaps 92 and 94, substantially parallel to hinge lines 96. The tearstrips so positioned will still allow one complete access to the packaged article.

CARTON ASSEMBLY

FIGS. 2–7

Figure 2:
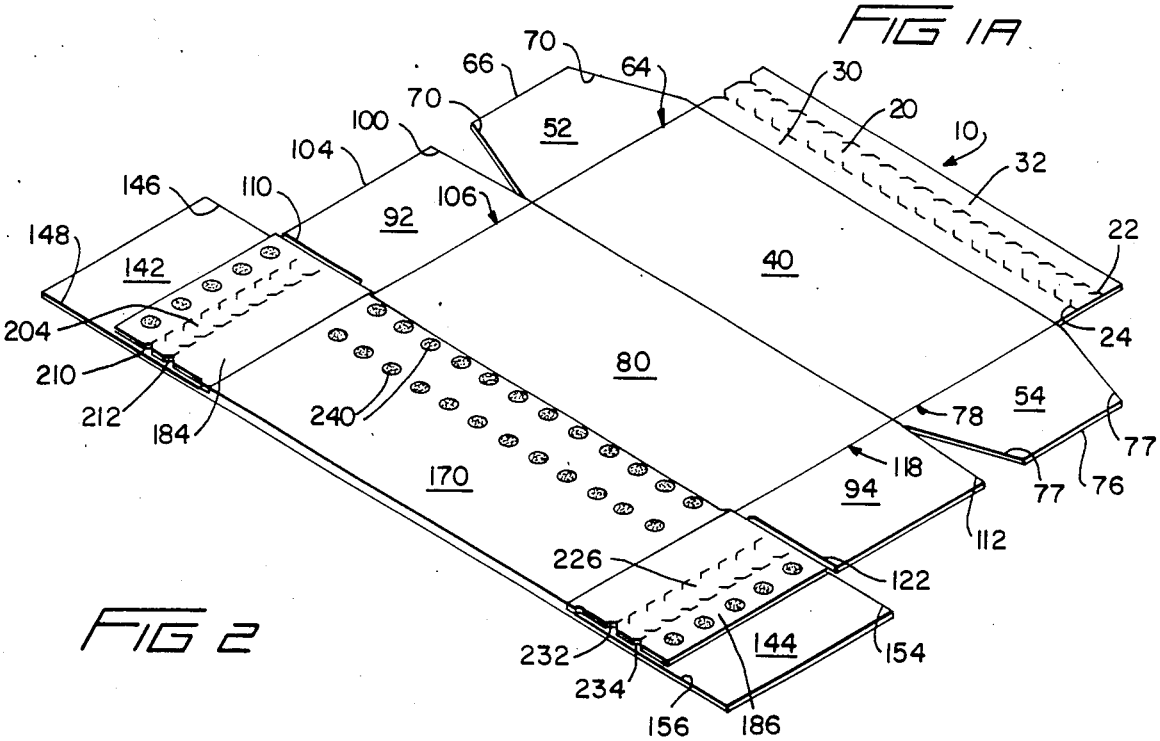
FIGS. 2 and 3 are plan views of the carton blank in the initial folding steps.
Figure 3:
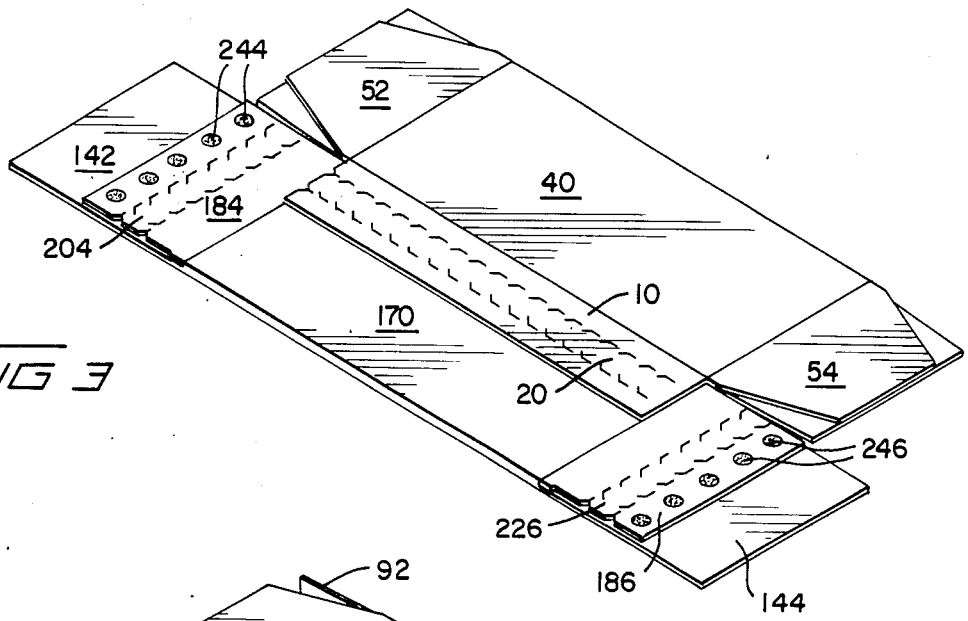
Figure 4:
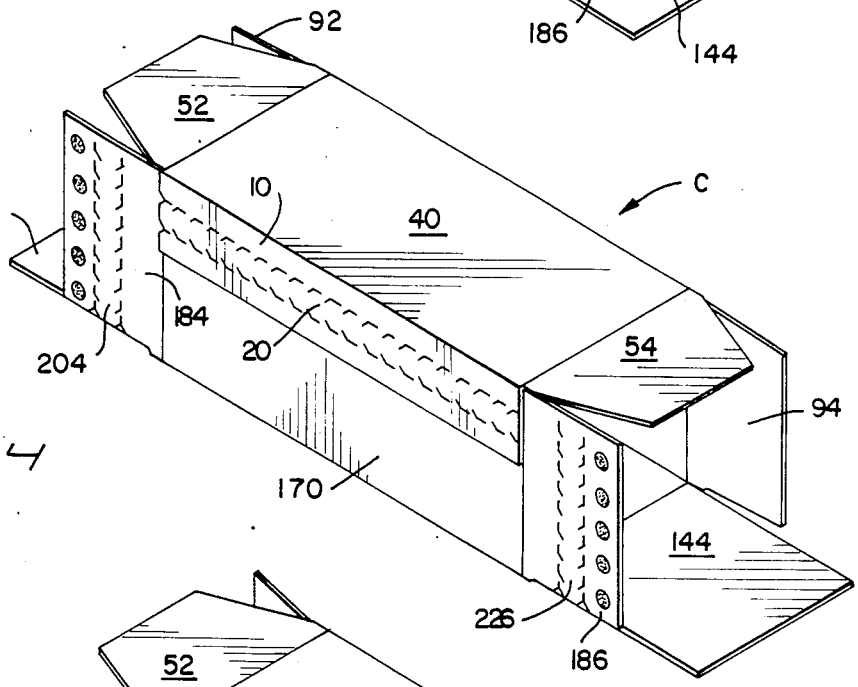
FIG. 4 is a perspective view of the carton with the body panels fully erected.

The specific steps taken for assemblying the carton will now be described. FIG. 2 illustrates the initial step taken to errect carton C. Front panel 170 is folded along hinge line 174 so that it lays flat on bottom panel 130. As seen in FIG. 2, a pair of adhesive strips 240 formed on front panel 170 run substantially parallel to a top edge 172. Referring to FIG. 3, cover panel 40 is folded along hinge line 44 so that cover panel 40 lays flat on rear panel 80 and closure flap 10 overlaps front panel 170. Pressure is applied to closure flap 10 to secure the closure flap to front panel 170. The body portion of the carton C is then errected. It should be noted that the adhesive strips 240 could similarly be positioned on closure flap 10.

Figure 5:
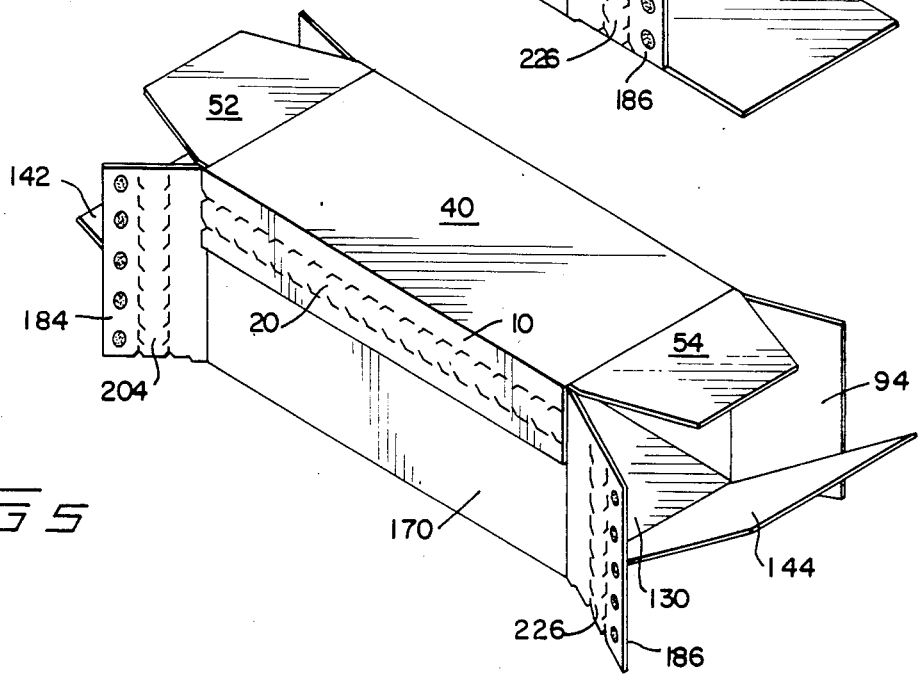
FIGS. 5 and 6 are side views of the carton illustrating the final folding steps.
Figure 6:
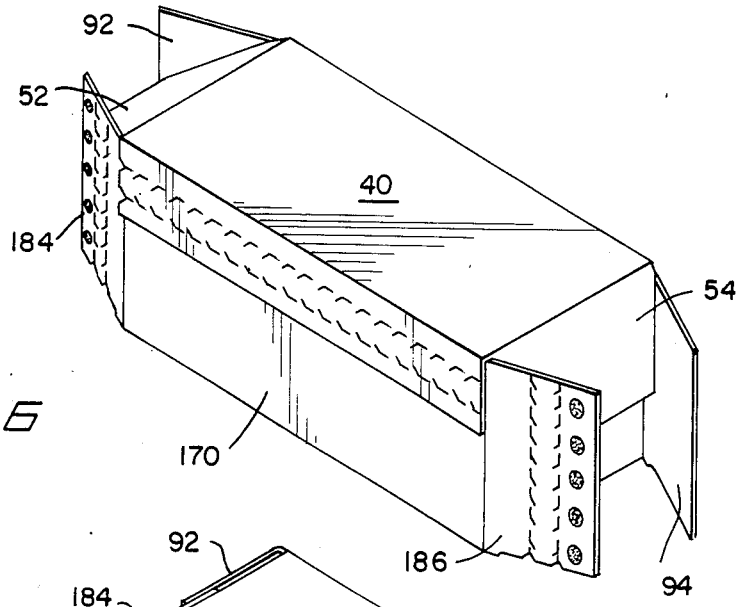

Turning now to FIGS. 5 and 6, end flaps 92, 94, 184 and 186 are expanded slightly outward in order that end flaps 142 and 144 can be folded in an upright position without resistance. End flaps 92, 94, 184 and 186 are moved slightly inward to secure end flaps 142 and 144 in an upright position. Cover end flaps 52 and 54 are folded along hinge lines 56 and 58 respectively in a downward position overlapping end walls 142 and 144. The angle formed between first portions 64 and 75 and second portions 66 and 77 allow folding of cover panel end flaps 52 and 54 without resistance thereto. End flaps 184 and 186 are folded inwardly along hinge lines 188 and 190 so that they overlap cover panel end flaps 52 and 54 and rear panel end flaps 142 and 144 respectively. Adhesive strips 244 and 246 are formed on end flaps 184 and 186 respectively. End flaps 92 and 94 are folded inward along hinge lines 96 and 98 so that they overlap front panel end flaps 184 and 186. The pressure is then applied to end flaps 92 and 94 to secure them to end flaps 184 and 186 respectively.

While the above described method of assembly is preferred, it should be noted that the adhesive strips 244 and 246 could be formed on rear panel end flaps 92 and 94. Also, the folding of rear panel end flaps 92 and 94 can occur prior to the folding of front panel end flaps 184 and 186 so that rear panel end flaps 92 and 94 will overlie front panel end flaps 184 and 186 respectively.

Figure 7:
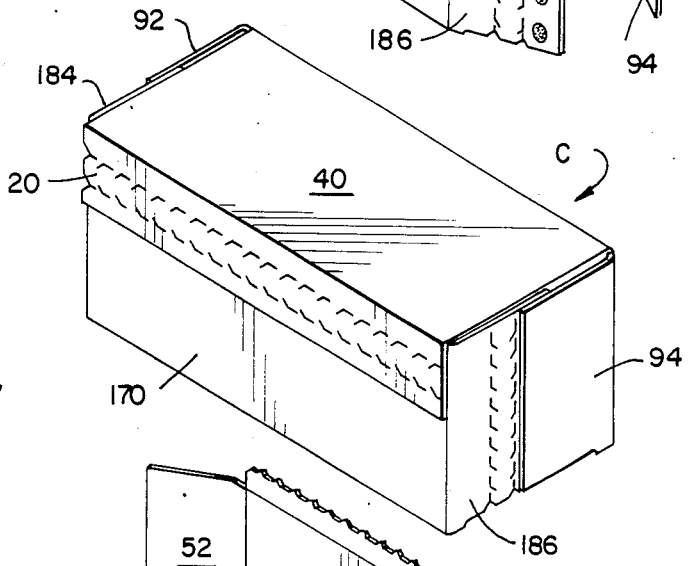
FIG. 7 is a perspective view of the finished carton.
Figure 8:
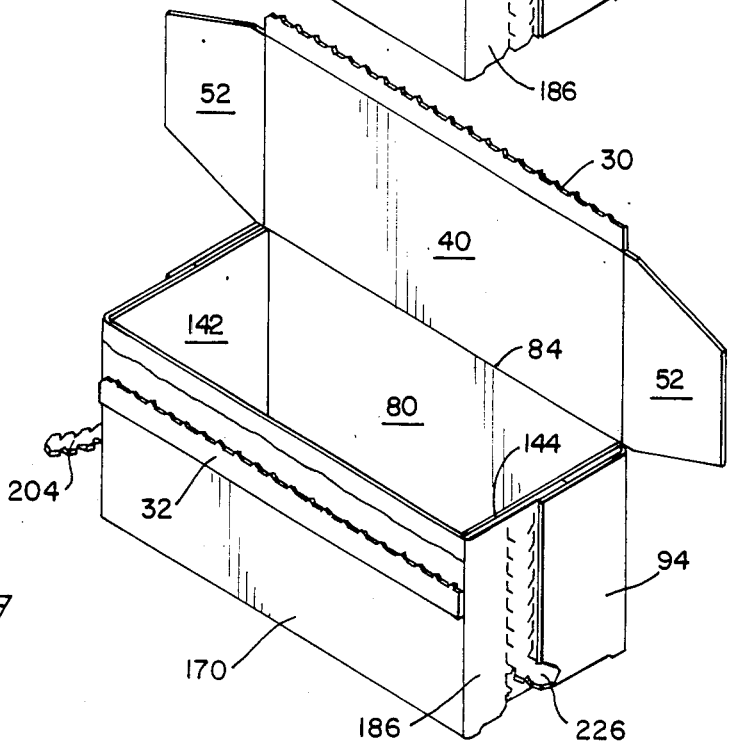
FIG. 8 is a perspective view of the carton with the tearstrips removed and the cover panel opened from the body portion of the carton and with the side tearstrips shown partially broken away.

The completed carton is illustrated in FIG. 7.

CARTON OPENING

FIG. 8

In order to gain access to the packaged article, the tear strips 20, 204 and 226 must be removed from closure flap 10, end wall 184, and end wall 186 respectively. Once the tear strip 20 is removed from closure flap 10, the cover panel 40 can be readily raised. Upon removal of tearstrips 204 and 226 the front panel 170 and rear panel 80 and the flaps 94, 144 and 186 on the right side of carton C and 92, 142 and 184 on the left side of carton C can be opened and the entire carton C laid out flat so that the contents in brick form can be sliced into rectangular equal portions. The above described arrangement of tearstrips 20, 204 and 226 is a significant improvement over the prior art. As stated earlier, one could only gain access to the packaged article through the cover portion of the carton. The present invention allows one limited access to packaged article by removal of tearstrip 10 solely or full access by the additional removal of tearstrips 204 and 226.

While this invention has been described as having a preferred design, it is understood that it is capable of further modification, uses and/or adaptations of the invention following in general the principle of the invention and including such departures from the present disclosure as come within known or customary practice in the art to which the invention pertains, such as may be applied to the essential features set forth, and fall within the scope of the invention of the limits of the appended claims.

What is claimed is:

1. A carton for packaging ice cream or the like, comprising:

(a) connected cover, front, bottom and rear panels, (b) said panels being substantially rectangular in shape, (c) each of said panels having left, right, top and bottom edges, (d) said cover panel having a closure flap hingedly connected to said cover panel at said cover panels top edge, (e) said rear panel hingedly connected at its top edge to said bottom edge of said cover panel, (f) said bottom panel hingedly connected at its top edge to said bottom edge of said rear panel, (g) said front panel hingedly connected at its top edge to said bottom edge of said bottom panel, (h) each of said panels having a left end flap hingedly connected to said left edge and a right end flap hingedly connected to said right edge, (i) said end flaps each having inner, outer, upper and lower edges, (j) said left and right rear panel end flaps extending from said left and right edges of said rear panel a distance sufficient to overlap said corresponding left and right front panel end flaps, (k) the length of said inner edges of said left and right bottom panel end flaps being substantially equal to the length of said left and right edges of said bottom panel respectively, (l) said closure flap having at least one weakness line running substantially parallel to said cover panel's top edge, (m) said left and right front panel end flaps comprising a first pair of end flaps and said left and right rear panel end flaps comprising a second pair of end flaps and one of said pair of flaps having a weakness line formed in each flap of said pair, (n) means for securing said closure flap to said front panel, and (o) means for securing said left and right front panel end flaps to said left and right rear panel end flaps respectively.

2. A carton for packaging ice cream or the like as in claim 1, wherein:

(a) said weakness lines formed in one of said first and second pairs of end flaps are tearstrips.

3. A carton for packaging ice cream or the like as in claim 2, wherein:

(a) said at least one weakness line formed in said closure flap is a tearstrip.

4. A carton for packaging ice cream or the like as in claim 1, wherein:

(a) said means for securing said closure flap to said front panel includes at least one adhesive strip running substantially along the length of said front panel and parallel to said top and bottom edges of said front panel.

5. A carton for packaging ice cream or the like as in claim 1, wherein:

(a) said left and right rear panel end flaps each have a single clearance cut in said left and right lower edges, and (b) said left and right front panel end flaps each have a single clearance cut in said left and right upper edges.

6. A carton for packaging ice cream or the like as in claim 2, wherein:

(a) said tearstrips are perpendicular to hinge lines formed between said bottom panel and said left and right bottom panel end flaps when the carton is fully erected.

7. A blank for forming a carton for packaging ice cream or the like, comprising:

(a) connected cover, front, bottom and rear panels, (b) said panels being substantially rectangular in shape, (c) each of said panels having left, right, top and bottom edges, (d) said cover panel having a closure flap hingedly connected to said cover panel at said cover panels top edge, (e) said rear panel hingedly connected at its top edge to said bottom edge of said cover panel, (f) said bottom panel hingedly connected at its top edge to said bottom edge of said rear panel, (g) said front panel hingedly connected at its top edge to said bottom edge of said bottom panel, (h) each of said panels having a left end flap hingedly connected to said left edge and a right end flap hingedly connected to said right edge, (i) said end flaps each having inner, outer, upper and lower edges, (j) said left and right rear panel end flaps extending from said left and right edges of said rear panel respectively a distance sufficient to overlay said corresponding left and right front panel end flaps, (k) said inner edges of said left and right bottom panel end flaps having a length substantially equal to the length of said left and right edges of said bottom panel respectively, (l) said closure flap having at least one weakness line running substantially parallel to said cover panel's top edge, and, (m) said left and right front panel end flaps comprising a first pair of end flaps and said left and right rear panel end flaps comprising a second pair of end flaps and one of said pair of end flaps having a weakness line formed in each flap of said pair.

8. A blank for forming a carton for packaging ice cream or the like as in claim 7, wherein:

(a) said weakness lines formed in one of said first and second pairs of end flaps are tearstrips.

9. A blank for forming a carton for packaging ice cream or the like as in claim 8, wherein:

(a) said at least one weakness line formed in said closure flap is a tearstrip.

10. A blank for forming a carton for packaging ice cream or the like as in claim 8, wherein:

(a) said tearstrips run substantially parallel to said inner and outer edges of said left and right front panel end flaps.

11. A blank for forming a carton for packaging ice cream or the like as in claim 7, wherein:

(a) said left and right rear panel end flaps each having a single clearance cut in said lower edges of said rear panel end flaps, (b) said left and right front panel end flaps each having a single clearance cut in said upper edge of said left and right front panel end flaps.

12. A blank for forming a carton for packaging ice cream or the like as in claim 7, wherein:

(a) said left and right cover panel end flaps include said upper and lower edges each of said upper and lower edges having first and second portions, (b) said first portions run perpendicular to hinge lines formed between said cover panel and said left and right cover panel end flaps for ensuring a proper seal, (c) said second portions form an obtuse angle less than 180° with said first portions, and (d) the length of said first portions is substantially less than the length of said second portions.

13. A blank for forming a carton for packaging ice cream or the like, comprising:

(a) connected cover, front, bottom and rear panels, (b) said panels being substantially rectangular in shape, (c) each of said panels having left, right, top and bottom panels, (d) said cover panel having a closure flap hingedly connected to said cover panel at said cover panels top edge, (e) said rear panel hingedly connected at its top edge to said bottom edge of said cover panel, (f) said bottom panel hingedly connected at its top edge to said bottom edge of said rear panel, (g) said front panel hingedly connected at its top edge to said bottom edge of said bottom panel, (h) each of said panels having a left end flap hingedly connected to said left edge and a right end flap hingedly connected to said left edge and a right end flap hingedly connected to said right edge, (i) said end flaps each having inner, outer, upper and lower edges, (j) said left and right rear panel end flaps extending from said left and right edges of said rear panel respectively, a distance sufficient to overlap said corresponding left and right front panel end flaps, (k) the length of said inner edges of said left and right bottom panel end flaps is substantially equal to the length of said left and right edges of said bottom panel respectively, (l) said left and right cover panel end flaps, rear panel end flaps, and said front panel end flaps all extend an equal distance from said left and right edges of said cover panel, rear panel, and front panel respectively, (m) said left and right bottom panel end flaps extend from said left and right edges of said bottom panel a distance greater than said left and right cover panel end flaps extend from said left and right edges of said cover panel.

14. A blank for forming a carton for packaging ice cream or the like as in claim 13, wherein:

(a) said cover flap has a tearline formed therein, and (b) one pair of said end flaps having at least one tearline formed therein.

15. A blank for forming a carton for packaging ice cream of the like as in claim 13, wherein:

(a) said left and right cover end flaps include upper and lower edges each having first and second portions, (b) said first portions run perpendicular to hinge lines formed between said cover panel and said left and right cover panel end flaps for ensuring a proper seal, (c) said second portions form an obtuse angle less than 180° with said first portions, and (d) the length of said first portions is substantially less than a length of said second portions.

16. A blank for forming a carton for packing ice cream or the like as in claim 13, wherein:

(a) said left and right front panel end flaps each have at least one notch formed in said upper edges for facilitating removal of a tear strip formed therein.

* * * * *